United States Patent [19]

Murai et al.

[11] 4,141,725

[45] Feb. 27, 1979

[54] ALUMINUM ALLOY FOR GALVANIC ANODE

[75] Inventors: Tohsuke Murai, Urawa; Yuichi Tamura, Tokyo, both of Japan

[73] Assignee: Nihon Boshoku Kogyo Kabushiki Kaisha, Tokyo, Japan

[21] Appl. No.: 860,571

[22] Filed: Dec. 14, 1977

[30] Foreign Application Priority Data

Feb. 14, 1977 [JP] Japan ..... 52-14310

[51] Int. Cl.[2] ..... C22C 21/10

[52] U.S. Cl. ..... 75/146; 204/148; 204/197; 204/293

[58] Field of Search ..... 75/146; 148/32, 32.5; 204/148, 197, 293

[56] References Cited

U.S. PATENT DOCUMENTS 3,694,196 9/1972 Toda et al. ..... 75/146

*Primary Examiner*—R. Dean

*Attorney, Agent, or Firm*—Flynn & Frishauf

[57] ABSTRACT

An aluminum alloy for a galvanic anode with improved anode potential and anode current efficiency, which consists of, in weight percentage:

Zinc from 0.5 to 10.0%,
Indium from 0.005 to 0.050%,
Calcium from 0.005 to 0.500%,
Magnesium from 0.1 to 4.0%, and
the balance aluminum and incidental impurities;

said alloy including an aluminum alloy for a galvanic anode further additionally containing at least one rare earth element of from 0.001 to 0.050% in weight percentage.

4 Claims, No Drawings

ALUMINUM ALLOY FOR GALVANIC ANODE

REFERENCE TO PATENTS, APPLICATIONS AND PUBLICATIONS PERTINENT TO THE INVENTION

So far as we know, the documents pertinent to the present invention are as follows:

(1) Japanese Pat. No. 490,888 (Patent Publication No. 2,358/64);

(2) Japanese Pat. No. 493,461 (Patent Publication No. 21,003/66); and (3) Japanese Pat. No. 560,078 (Patent Publication No. 14,291/67).

The contents of the prior arts disclosed in the documents listed above will be described later in the "Background of the Invention".

FIELD OF THE INVENTION

The present invention relates to an improvement of an Al-Zn-In aluminium alloy for a galvanic anode to be used for the cathodic protection of steel structures in sea-water.

BACKGROUND OF THE INVENTION

Aluminum alloys in such series as Al-Zn-Hg, Al-Zn-Sn and Al-Zn-In are known as materials for a galvanic anode (also called "sacrificial anode") to be used for the cathodic protection of steel structures in sea-water or quasi-sea-water (hereinafter generically referred to as "sea-water").

Of these conventional aluminum alloys for a galvanic anode, Al-Zn-Hg alloys cannot be used without a problem of environmental contamination caused by the mercury (Hg) contained therein. Also, it is difficult to use Al-Zn-Sn alloys without a problem of productivity because of the necessity of subjecting said alloys to a solution treatment to impart excellent galvanic performances. In the case of Al-Zn-In alloys, in contrast, they do not have such problems as observed in the aforementioned alloys of Al-Zn-Hg and Al-Zn-Sn, and in addition, since Al-Zn-In aluminum alloys display excellent galvanic performances, said alloys are being employed broadly as materials for a galvanic anode.

For instance, the following alloys are known as typical examples of the aforementioned Al-Zn-In aluminum alloys for use as materials for the galvanic anode:

(1) An aluminum alloy consisting of the following elements in weight percentage, as disclosed in Japanese Pat. No. 490,888 (Patent Publication No. 2,358/64):
Zinc from 0.5 to 20%,
Indium from 0.005 to 0.1%, and
the balance aluminum and incidental impurities;

(2) An aluminum alloy consisting of the following elements in weight percentage, as disclosed in Japanese Pat. No. 493,461 (Patent Publication No. 21,003/66):
Zinc from 0.5 to 20%,
Indium from 0.005 to 0.1%,
Calcium from 0.005 to 0.05%, and
the balance aluminum incidental impurities (3) An aluminum alloy consisting of the following elements in weight percentage, as disclosed in Japanese Pat. No. 560,078 (Patent Publication No. 14,291/67):
Zinc from 1.0 to 10%,
Indium from 0.01 to 0.05%, Magnesium from 0.05 to 3%,
Manganese from 0.05 to 0.5%, and
the balance aluminum and incidental impurities.

The aluminum alloy given in (1) above, when used as the material for a galvanic anode, exhibits excellent galvanic performances such as an anode potential of from about −1,070 to about −1,100 mV (measured with the use of a saturated calomel electrode as the standard electrode; the same shall apply hereinafter) and an anode current efficiency of from about 70 to about 84%.

However, with the aluminum alloy given in (1) above, when used at a low current density, aluminum hydroxide produced by the dissolution of aluminum tends to stick to the dissolved surface of the galvanic anode. Because of this trend, the area of the dissolved surface, i.e., of the active surface of the galvanic anode, is reduced with the lapse of time, thereby causing a decrease in the generated electric current, and hence a decrease in the anode current efficiency.

The aluminum alloy given in (2) above, which is an improvement of the aluminum alloy given in (1) above, is obtained by adding from 0.005 to 0.05 wt. % calcium to the latter. When said aluminum alloy given in (2) above is used as the material for a galvanic anode, almost no reduction in the area of the active surface of the galvanic anode occurs, and as a result, it exhibits stable and excellent galvanic performances such as an anode potential of from about −1,110 to about −1,120 mV and an anode current efficiency of from about 80 to about 85% because the effect of the added calcium prevents adhesion of the produced aluminum hydroxide to the dissolved surface of the galvanic anode.

However, since indium forms almost no solid solution with aluminum and zinc, indium disperses unevenly in an Al-Zn-In aluminum alloy in melting said alloy. For this reason, when said aluminum alloy given in (2) above is used as the material for a galvanic anode, there occurs fluctuation of the conditions of the dissolved surface, i.e., of the active surface of the galvanic anode, because of the non-uniform dissolution of the galvanic anode. The use of said alloy in a galvanic anode therefore poses a problem of fluctuation and instability of the anode potential. This problem occurs also in the case of the aluminum alloy given in (1) above.

The aluminum alloy given in (3) above, which is an improvement of Al-Zn-In aluminum alloys, is obtained by adding from 0.05 to 3 wt.% magnesium and from 0.05 to 0.5 wt.% manganese as needed to an aluminum alloy consisting essentially of aluminum, zinc and indium.

Magnesium easily forms a solid solution with indium and also with aluminum. Consequently, in melting an Al-Zn-In aluminum alloy, if an appropriate amount of magnesium is added, indium is contained in the alloy in uniform dispersion. Furthermore, the addition of an appropriate amount of manganese permits utilization of an aluminum of a relatively low grade as the material for an aluminum alloy.

Therefore, when the aluminum alloy given in (3) above is used as the material for a galvanic anode, the galvanic anode dissolves uniformly because indium is contained in the alloy in uniform dispersion under the effect of magnesium addition, and hence, the anode potential is stabilized. As a result, even if a relatively low-grade aluminum is used as the material, there are available excellent galvanic performances such as an anode potential of from about −1,070 to about −1,100 mV and an anode current efficiency of from about 84 to 90%.

The above-mentioned three types of Al-Zn-In aluminum alloys given as typical examples certainly exhibit excellent galvanic performances when they are used as galvanic anodes for the cathodic protection of steel structures in sea-water at a temperature of over about 10° C. However, when these aluminum alloys are used as galvanic anodes for the cathodic protection of steel structures in sea-water at a relatively low temperature of up to about 10° C, they do not necessarily exhibit stable galvanic performances. More specifically, the Al-Zn-In aluminum alloys given in (1) to (3) above display excellent galvanic performances such as an anode potential of from about −1,070 to about −1,120 mV and an anode current efficiency of from about 70 to about 90% in sea-water at a temperature of over about 10° C. as described above. However, when they are used in sea-water at a relatively low temperature of up to about 10° C., they do not necessarily exhibit stable galvanic performances, and the anode potential scatters among galvanic anodes. Accordingly, although some galvanic anodes exhibit galvanic performances similar to those available sea-water at a temperature of over about 10° C., others do not become less noble to the desired level of anode potential (about −1,100 mV) and show only about −960 mV. This trend of the scattering in the anode potential is more serious as the temperature of sea-water becomes lower.

SUMMARY OF THE INVENTION

An object of the present invention is therefore to provide an improved Al-Zn-In aluminum alloy for a galvanic anode to be used for the cathodic protection of steel structures in sea-water.

The principal object of the present invention is to provide an Al-Zn-In aluminum alloy for a galvanic anode to be used for the cathodic protection of steel structures, of which the anode potential becomes less noble in a very short period of time even in sea-water at a low temperature of up to about 10° C. and which exhibits excellent galvanic performances including a stable anode current efficiency similar to those available in sea-water at a temperature of over about 10° C.

Another object of the present invention is to provide an Al-Zn-In aluminum alloy for galvanic anode to be used for the cathodic protection of steel structures, of which the anode potential becomes noble only at a very slight rate even in service for a long period of time and which exhibits excellent galvanic performances including a stable anode current efficiency.

In accordance with one of the features of the present invention, there is provided an aluminum alloy for a galvanic anode which consists of, in weight percentage:

Zinc from 0.5 to 10.0%,
Indium from 0.005 to 0.050%,
Calcium from 0.005 to 0.500%,
Magnesium from 0.1 to 4.0%, and
the balance aluminum and incidental impurities;

said aluminum alloy including an aluminum alloy for a galvanic anode further additionally containing at least one rare earth element of from 0.001 to 0.050% in weight percentage.

DETAILED DESCRIPTION OF PREFERRED EMBODIMENTS

Causes of the aforementioned scattering in the anode potential in the conventional Al-Zn-In aluminum alloys are considered as follows. The conventional alloys exhibit excellent galvanic performances when the aluminum-zinc solid solution thereof contains indium over a certain amount in uniform dispersion. However, a galvanic anode, which displays a sufficiently less noble anode potential in sea-water at a temperature of over about 10° C., often shows an anode potential of only about −960 mV in low-temperature sea-water of up to about 10° C. This seems to be due to the adverse effects of the low-temperature sea-water acting on the structure of the active surface of the galvanic anode as well as on the rate of dissolving reaction. It is evident that these adverse effects are related with the indium content in the alloy: a higher indium content in the alloy results in an improved structure of the active surface and a rate of dissolving reaction, and permits achievement of a less noble anode potential even in low-temperature sea-water of up to about 10° C. However, a higher indium content in the alloy causes an increase in the amount of self-corrosion of the galvanic anode, and results in a serious problem of the remarkable reduction in the anode current efficiency. It is therefore impossible to solve the problems inherent in the conventional Al-Zn-In aluminum alloys, particularly, those observed in the use in low-temperature sea-water of up to about 10° C., merely by increasing the indium content.

We have carried out intensive studies to solve the aforementioned problems inherent in the conventional Al-Zn-In aluminum alloys, and as a result we have found that it is possible to obtain an Al-Zn-In aluminum alloy for galvanic anode to be used for the cathodic protection of steel structures in low-temperature sea-water of up to about 10° C. with almost no reduction in the anode current efficiency and with very little scattering in the anode potential, and which has excellent and stable galvanic performances in service for a long period of time, by adding to the conventional Al-Zn-In aluminum alloy calcium and magnesium in coexistence and by imparting a chemical composition consisting of, in weight percentage:

Zinc from 0.5 to 10.0%,
Indium from 0.005 to 0.050%,
Calcium from 0.005 to 0.500%,
Magnesium from 0.1 to 4.0%, and
the balance aluminum and incidental impurities, (hereinafter referred to as "the first alloy" of the present invention), and also that it is possible to obtain another Al-Zn-In aluminum alloy for a galvanic anode which has an anode potential becoming noble less than said first alloy in service for a long period of time, by adding to said first alloy at least one rare earth element of from 0.001 to 0.050% in weight percentage (hereinafter referred to as "the second alloy" of the present invention).

Now, the reasons for limiting the ranges of the chemical compositions of the first and the second alloys of the present invention as described above are given below:

(1) Zinc

As mentioned above, Al-Zn-In aluminum alloys exhibit excellent galvanic performances when the aluminum-zinc solid solution thereof contains indium over a certain amount in uniform dispersion.

However, a zinc content of under 0.5 wt.% in the aluminum-zinc solid solution is too low to obtain desired galvanic anode characteristics even if indium is added to it. Therefore, it is necessary that the zinc content should be at least 0.5 wt.%. On the other hand, if zinc is added in an amount of over 10.0 wt.%, there is almost no decrease in the galvanic anode characteristics, while because the theoretical quantity of generated electricity of zinc is low as compared with aluminum, the effective quantity of electricity as a galvanic anode decreases and castability also deteriorates with the increase in the zinc content. Consequently, the zinc content should be up to 10.0 wt.%.

(2) Indium

As mentioned above, indium has a function to impart excellent galvanic anode characteristics to an aluminum alloy, i.e., it tends to improve the anode current efficiency by making the anode potential of said alloy less noble.

However, if the indium content is under 0.005 wt.%, it is impossible to provide an aluminum alloy with desired galvanic anode characteristics. Consequently, it is necessary that the indium content should be at least 0.005 wt.%. On the other hand, if the indium content is over 0.050 wt.%, the amount of self-corrosion on the dissolved portions of the galvanic anode increases, thereby remakably lowering the anode current efficiency. Furthermore, since indium is an expensive metal, it is uneconomical to use it in excess of the amount needed. The indium content should therefore be up to 0.050 wt.%.

(3) Calcium, Magnesium and Rare Earth Elements

As mentioned previously in our comments on the conventional Al-Zn-In aluminum alloys, it is known that, by adding calcium to said alloys in an appropriate amount, adhesion of corrosion products to the dissolved surface of the galvanic anode can be prevented. It is also known that, by adding an appropriate amount of magnesium, indium is contained in the aluminum alloy in uniform dispersion.

When a conventional Al-Zn-In aluminum alloy containing either calcium or magnesium is used as a galvanic anode for the cathodic protection of steel structures in sea-water at a temperature of over about 10° C., it displays relatively excellent galvanic performances. However, when used as a galvanic anode in low-temperture sea-water of up to about 10° C., some galvanic anodes inevitably show insufficient galvanic anode characteristics, because not only the anode potential scatters among galvanic anodes but also the degree of the galvanic anode becoming less noble is insufficient.

In the present invention, calcium, magnesium and at least one rare metal element are contained in coexistence in a conventional Al-Zn-In aluminum alloy in appropriate amounts with a view to improving the above-mentioned galvanic anode characteristics of said aluminum alloy.

More specifically, in the present invention, not only the scattering in the anode potential is largely reduced but also the galvanic anode becomes more easily less noble and the anode current efficiency is further improved, by adding calcium, magnesium and at least one rare earth element, which have a considerably less noble standard anode potential than aluminum, in coexistence in a conventional Al-Zn-In aluminum alloy.

Calcium, magnesium and rare earth elements have two functions: one is to form a smooth dissolved surface of the galvanic anode by permitting uniform dissolution of the anode; and the other is to soften corrosion products adhering to the surface of the galvanic anode so that such corrosion products can be peeled off readily from the surface of the galvanic anode. Because of the former function, the area of the effective dissolved surface area of the galvanic anode is increased, thereby ensuring a wider area of steel structures to be protected against corrosion. Because of the latter function, it is possible to prevent the anode potential of the galvanic anode from becoming noble as a result of sticking films of corrosion products and to prevent the anode current generated from decreasing, thus permitting maintenance of stable initial galvanic performances until the galvanic anode is worn out.

In the present invention, the galvanic anode exhibits an excellent galvanic performance by only adding calcium and magnesium in coexistence in an Al-Zn-In aluminum alloy (i.e., the first alloy of the present invention), but if at least one rare earth element is added in coexistance with calcium and magnesium, (i.e., the second alloy of the present invention), it is possible to further reduce the degree of anode potential becoming noble in a long-term service. In the present invention, it is possible to use any rare earth element available, whereas the use of cerium is generally effective and economical.

However, it is not possible to achieve the desired results of the aforementioned two functions with a calcium content of under 0.005 wt.%, a magnesium content of under 0.1 wt.% and the content of at least one rare earth element of under 0.001 wt.%. Consequently, the contents of calcium, magnesium and at least one rare earth element should be at least 0.005 wt.%, 0.1 wt.% and 0.001 wt.%, respectively. On the other hand, however, if the calcium content is over 0.500 wt.%, the anode potential becomes excessively less noble(excessively activated) with resultant increase in the amount of self-corrosion of the galvanic anode. If the magnesium content is over 4.0 wt.%, intergranular corrosion of the aluminum alloy prevails and corrosion products adhere to the surface of the galvanic anode with resultant decrease in the anode current efficiency. With a content of the rare earth element of over 0.050 wt.%, the amount of self-corrosion of the galvanic anode increases, and moreover, since the rare earth elements are expensive, it is uneconomical to use it in an amount more than required. Therefore, the contents of calcium, magnesium and at least one rare earth element should be up to 0.500 wt.%, 4.0 wt.% and 0.050 wt.%, respectively.

Now, the aluminun alloy for a galvanic anode of the present invention is described more in detail in comparison with reference alloys by means of some examples.

EXAMPLE 1

Six galvanic anodes having a diameter of 15 mmϕ and a length of 120 mm were prepared each from the first alloys 1 and 2 and the second alloys 1 and 2 of the present invention and reference alloys 1 to 3 outside the scope of the present invention, having respective chemical compositions as shown in Table 1. The second alloys 1 and 2 of the present invention contained a rare earth element through the addition of a misch metal (composition; 95.7 wt.% rare earth element, 0.7 wt.% Si, .3 wt.% Fe and 2.3 wt.% other elements) during melting of the alloy (the same applies also in Examples 2 to 4 described later).

These galvanic anodes were subjected to anodic performance tests in a low-temperature artificial seawater at a temperature of 0° C. by passing electric current from an external source for 240 hours at an anodic current density of 1.0 mA/cm$^2$. In said performance tests, the anode potential was measured after energizing for 240 hours, and also, the anode current efficiency was calculated. Results of said performance tests are also given in Table 1. In Table 1, the anode current efficiency is indicated by means of average values over anode current efficiencies for the six galvanic anodes for each alloy, and the anode potential is expressed by the maximum and the minimum anode potentials among six galvanic anodes for each alloy, as measured with a saturated calomel electrode as the standard electrode.

Table 1

| Kind of alloy of the present invention | | Chemical composition (wt. %) Al and Impurities | Zn | In | Ca | Mg | Rare earth element | Anode potential (−mV) | Anode current efficiency (%) |
|---|---|---|---|---|---|---|---|---|---|
| First | 1 | Balance | 4.5 | 0.02 | 0.05 | 0.5 | — | 1090 - 1120 | 92.3% |
| alloy | 2 | Balance | 4.5 | 0.02 | 0.02 | 2.0 | — | 1110 - 1125 | 92.8 |
| Second | 1 | Balance | 4.5 | 0.02 | 0.02 | 2.0 | 0.010 | 1100 - 1120 | 93.0 |
| alloy | 2 | Balance | 4.5 | 0.025 | 0.05 | 1.0 | 0.005 | 1105 - 1120 | 93.2 |
| Reference | 1 | Balance | 4.5 | 0.02 | 0.02 | — | — | 980 - 1120 | 89.5 |
| | 2 | Balance | 4.5 | 0.02 | — | 0.5 | — | 1010 - 1115 | 90.0 |
| alloy | 3 | Balance | 4.5 | 0.02 | — | — | 0.02 | 980 - 1110 | 89.2 |

As is evident from the results given in Table 1, in the first alloys 1 and 2 of the present invention containing both calcium and magnesium and in the second alloys 1 and 2 of the present invention containing a rare earth element in addition to calcium and magnesium, the scattering in the anode potential among galvanic anodes of the same alloy is so small as 30 mV (the first alloy 1), 15 mV (the first alloy 2), 20 mV (the second alloy 1) and 15 mV (the second alloy 2) and the anode current efficiency exceeds 92% in all cases, thus proving excellent galvanic performances. As is clear from the comparison of the first alloys and the second alloys of the present invention in Table 1, the second alloys show the effect of addition of a rare earth element: although almost no difference was observed in the anode potential, the second alloys are slightly superior to the first alloys in terms of the anode current efficiency.

In the reference alloys 1 to 3 outside the scope of the present invention, in contrast, which contain singly any of calcium, magnesium and a rare earth element, the scattering in the anode potential among galvanic anodes of the same alloy is so large as 140 mV (the reference alloy 1), 105 mV (the reference alloy 2) and 130 mV (the reference alloy 3), and the anode current efficiency is as low as 90% at the maximum.

In the observation of the surface condition of all the anodes after the aforementioned tests, the anode surfaces were uniformly dissolved into smooth surfaces in the alloys of the present invention, whereas the seriously irregular anode surfaces in the reference alloys outside the scope of the present invention suggested a non-uniform dissolution.

EXAMPLE 2

One galvanic anode having the same dimensions as in Example 1 was prepared each from the first alloys 3 to 6 and the second alloys 3 to 6 of the present invention and the reference alloys 4 to 9 outside the scope of the present invention, having respective chemical compositions as shown in Table 2.

These galvanic anodes were subjected to anodic performance tests under the same conditions as in Example 1 except for the temperature of the artifcial sea-water changed to 5° C. Results of said performance tests are also indicated in Table 2.

Table 2

| Kind of alloy of the present invention | | Chemical Composition (wt. %) Al and Impurities | Zn | In | Ca | Mg | Rare earth element | Anode potential (−mV) | Anode current efficiency (%) |
|---|---|---|---|---|---|---|---|---|---|
| | 3 | Balance | 2.5 | 0.02 | 0.02 | 0.5 | — | 1115 | 92.3 |
| First | 4 | Balance | 4.5 | 0.02 | 0.05 | 0.5 | — | 1110 | 92.2 |
| alloy | 5 | Balance | 4.5 | 0.02 | 0.02 | 2.0 | — | 1120 | 92.8 |
| | 6 | Balance | 4.5 | 0.03 | 0.05 | 1.0 | — | 1125 | 91.7 |
| | 3 | Balance | 2.5 | 0.02 | 0.02 | 2.0 | 0.010 | 1115 | 93.1 |
| Second | 4 | Balance | 4.5 | 0.025 | 0.05 | 1.0 | 0.003 | 1120 | 93.1 |
| alloy | 5 | Balance | 4.5 | 0.02 | 0.01 | 2.0 | 0.010 | 1115 | 93.8 |
| | 6 | Balance | 4.5 | 0.02 | 0.30 | 0.5 | 0.040 | 1120 | 92.9 |
| | 4 | Balance | 2.5 | 0.02 | 0.02 | — | — | 980 | 87.4 |
| | 5 | Balance | 4.5 | 0.02 | 0.04 | — | — | 1110 | 89.7 |
| Reference | 6 | Balance | 4.5 | 0.02 | — | 0.5 | — | 1030 | 89.5 |
| alloy | 7 | Balance | 2.5 | 0.02 | — | 2.0 | — | 1100 | 90.3 |
| | 8 | Balance | 4.5 | 0.02 | — | — | 0.020 | 1000 | 88.2 |
| | 9 | Balance | 4.5 | 0.025 | 0.7 | 1.0 | 0.010 | 1080 | 81.1 |

As is evident from the results given in Table 2, in the first alloys 3 to 6 of the present invention containing both calcium and magnesium and in the second alloys 3 to 6 of the present invention containing a rare earth element in addition to calcium and magnesium, the scattering in the anode potential among different galvanic anodes is so small as 15 mV (the first alloy) and 5 mV (the second alloy), and even when varying the chemical composition of alloy within the ranges of chemical composition specified in the present invention, the anode potential is stable and sufficiently less noble. Furthermore, except for 91.7% for the first alloy 6, the anode current efficiency exceeds 92% in all cases, thus proving excellent galvanic performances. In Table 2, as is clear from the comparison of the first alloys and the second alloys of the present invention, the second alloys show the effect of addition of a rare element: the second alloys are superior to the first alloys both in the degree of the scattering in the anode potential and in the anode current efficiency.

In the reference alloys 4 to 8 outside the scope of the present invention, in contrast, which contain singly any of calcium, magnesium and a rare earth element, the scattering in the anode potential among different galvanic anodes is so large as 130 mV, and the anode current efficiency is under 90% in all cases except for 90.3% for the reference alloy 7. In the reference alloy 9 outside the scope of the present invention which, containing all of calcium, magnesium and a rare earth element, has a calcium content of 0.7 wt.% exceeding the range of calcium contents as specified in the present invention (from 0.005 to 0.500 wt.%), the test results are inferior to those of the alloys of the present invention in terms of both the anode potential and the anode current efficiency.

In the observation of the surface condition of all the anodes after the aforementioned tests, the anode surfaces were uniformly dissolved into smooth surfaces in the alloys of the present invention as observed in Example 1, whereas the seriously irregular anode surfaces in the reference alloys outside the scope of the present invention suggested a non-uniform dissolution.

EXAMPLE 3

One galvanic anode having the same dimensions as in Example 1 was prepared each from the first alloys 7 to 12 and the second alloys 7 to 11 of the present invention and the reference alloys 10 to 13 outside the scope of the present invention, having respective chemical compositions as shown in Table 3.

These galvanic anodes were subjected to anodic performance tests under the same conditions as in Example 1 except for the temperature of the artificial sea-water changed to 30° C. Results of said performance tests are also indicated in Table 3.

Table 3

| Kind of alloy of the present invention | | Chemical Composition (wt. %) Al and Impurities | Zn | In | Ca | Mg | Rare earth element | Anode potential (−mV) | Anode current efficiency (%) |
|---|---|---|---|---|---|---|---|---|---|
| First alloy | 7 | Balance | 2.5 | 0.02 | 0.02 | 0.5 | — | 1110 | 88.6 |
| | 8 | Balance | 4.5 | 0.02 | 0.05 | 0.5 | — | 1110 | 90.1 |
| | 9 | Balance | 4.5 | 0.02 | 0.02 | 2.0 | — | 1115 | 90.3 |
| | 10 | Balance | 4.5 | 0.02 | 0.40 | 2.0 | — | 1140 | 88.9 |
| | 11 | Balance | 4.5 | 0.03 | 0.05 | 1.0 | — | 1115 | 89.2 |
| | 12 | Balance | 9.0 | 0.02 | 0.02 | 0.5 | — | 1090 | 89.7 |
| Second alloy | 7 | Balance | 2.5 | 0.02 | 0.02 | 2.0 | 0.010 | 1110 | 91.5 |
| | 8 | Balance | 4.5 | 0.025 | 0.05 | 1.0 | 0.003 | 1100 | 91.1 |
| | 9 | Balance | 4.5 | 0.02 | 0.01 | 2.0 | 0.010 | 1115 | 92.0 |
| | 10 | Balance | 4.5 | 0.02 | 0.30 | 0.5 | 0.040 | 1115 | 91.0 |
| | 11 | Balance | 9.0 | 0.02 | 0.01 | 0.5 | 0.020 | 1100 | 91.2 |
| Reference alloy | 10 | Balance | 4.5 | 0.02 | 0.02 | — | — | 1105 | 87.4 |
| | 11 | Balance | 4.5 | 0.02 | — | 0.5 | — | 1110 | 88.2 |
| | 12 | Balance | 4.5 | 0.02 | 0.02 | 5.0 | — | 990 | 71.9 |
| | 13 | Balance | 4.5 | 0.02 | — | — | 0.020 | 1105 | 87.2 |

As is evident from the results given in Table 3, in the first alloys 7 to 12 of the present invention containing both calcium and magnesium and in the second alloys 7 to 11 of the present invention containing a rare earth element in addition to calcium and magnesium, the scattering in the anode potential among different galvanic anodes is so small as 50 mV (the first alloy) and 15 mV (the second alloy) even in the artificial sea-water at 30° C., and even when varying the chemical composition of alloy within the ranges of chemical composition specified in the present invention, the anode potential is stable and sufficiently less noble. Furthermore, the anode current efficiency exceeds 91% in all cases, thus proving excellent galvanic performances. In Table 3, as is clear from the comparison of the first alloys and the second alloys of the present invention, the second alloys show the effect of addition of a rare earth element: the second alloys are superior to the first alloys both in the degree of the scattering in the anode potential and in the anode current efficiency.

In the reference alloys 10, 11 and 13 outside the scope of the present invention, in contrast, which contain singly any of calcium, magnesium and a rare earth element the anode potential shows a value almost identical with those of the alloys of the present invention, whereas the anode current efficiency is far inferior to those of the alloys of the present invention. In the reference alloy 12 outside the scope of the present invention which, containing both calcium and magnesium, has a magnesium content of 5.0 wt.% exceeding the range of magnesium contents as specified in the present invention (from 0.1 to 4.0 wt.%), the test results are far inferior to those of the alloys of the present invention in terms of both the anode potential and the anode current efficiency.

In the observation of the surface condition of all the anodes after the aforementioned tests, the anode surfaces were uniformly dissolved into smooth surfaces in the alloys of the present invention as observed in Examples 1 and 2, whereas the seriously irregular anode surfaces in the reference alloys outside the scope of the present invention suggested a non-uniform dissolution.

EXAMPLE 4

One galvanic anode having the same dimensions as in Example 1 was prepared each from the first alloy 13 and the second alloy 12 of the present invention and the reference alloy 11 outside the scope of the present invention, having respective chemical compositions are shown in Table 4.

These galvanic anodes were subjected to long-term anodic performance tests in an artificial sea-water at a temperature of 30° C. by passing electricity from an external source for a period of three months at an anodic current density of 0.3 mA/cm$^2$. In said performance tests, measurement of the anode potential and calculation of the anode current efficiency were carried out at intervals of a month. The anode potential was measured with a saturated calomel electrode as the standard electrode as in Examples 1 to 3. Results of said performance tests are also given in Table 4.

Table 4

| Kind of alloy of the present invention | | Chemical Composition (wt. %) | | | | | | Anode potential (−mV) | | | Anode current efficiency 3 months after |
|---|---|---|---|---|---|---|---|---|---|---|---|
| | | Al and Impurities | Zn | In | Ca | Mg | Rare earth element | A month after | 2 months after | 3 months after | |
| First alloy | 13 | Balance | 4.5 | 0.02 | 0.02 | 2.0 | — | 1115 | 1110 | 1100 | 90.2 |
| Second alloy | 12 | Balance | 4.5 | 0.02 | 0.01 | 2.0 | 0.01 | 1115 | 1115 | 1110 | 91.9 |
| Reference alloy | 11 | Balance | 4.5 | 0.02 | — | 0.5 | — | 1110 | 1095 | 1085 | 87.3 |

As is evident from the results given in Table 4, in the first alloy 13 of the present invention containing both calcium and magnesium and in the second alloy 12 of the present invention containing a rare earth element in addition to calcium and magnesium, the decrease in the anode potential in only 15 mV (the first alloy) and 5 mV (the second alloy) even after three months' energizing, and the anode potential is very stable and less noble. Furthermore, the anode current efficiency exceeds 90% in all cases even after three months' energizing, thus proving excellent galvanic performances. In Table 4, as is clear from the comparison of the first alloy and the second alloy of the present invention, the second alloy shows the effect of addition of a rare earth element: the second alloy is superior to the first alloy both in the degree of decrease in the anode potential and in the anode current efficiency.

In the reference alloy 11 outside the scope of the present invention, in contrast, which singly contains magnesium, the anode potential decreases by 25 mV and the anode current efficiency shows a value of only 87% after the lapse of three months of energizing, under the adverse effect of increase in the amount of corrosion products sticking to the anode surface with the lapse of time.

In the observation of the surface condition of all the anodes after the aforementioned three-month performance tests, the anode surfaces were uniformly dissolved into smooth surfaces in the alloys of the present invention, whereas the seriously irregular anode surface in the reference alloy outside the scope of the present invention suggested a non-uniform dissolution.

According to the present invention, as described above in detail, it is possible to obtain an Al-Zn-In aluminum alloy for galvanic anode to be used for the cathodic protection of steel structures, which shows a very slight decrease in the anode potential and has a stable anode current efficiency even in low-temperature sea-water of up to about 10° C., as in sea-water at a temperature of over about 10° C., with a very slight decrease in the anode potential and the anode current efficiency even after a long-term service, always displaying excellect galvanic performances, thus providing industrially useful effects.

What is claimed is:

1. An aluminum alloy for a galvanic anode which consists of, in weight percentage:
Zinc from 0.5 to 10.0%,
Indium from 0.005 to 0.050%
Calcium from 0.005 to 0.500%,
magnesium from 0.1 to 4.0%, and
the balance aluminum and impurities.

2. An aluminum alloy for a galvanic anode which consists of, in weight percentage:
Zinc from 0.5 to 10.0%,
Indium from 0.005 to 0.050%,
Calcium from 0.005 to 0.500%,
Magnesium from 0.1 to 4.0%,
at least one rare earth element from 0.001 to 0.050%, and
the balance aluminum and impurities.

3. An aluminum alloy of claim 1 consisting of
Zinc 4.5%,
Indium 0.02%,
Calcium 0.02%,
Magnesium 2.0%, and
the balance aluminum and impurities.

4. An aluminum alloy of claim 2 consisting of
Zinc 4.5%,
Indium 0.02%,
Calcium 0.01%
Magnesium 2.0%,
rare earth metal in misch metal 0.01%, and
the balance aluminum and impurities.

* * * * *